United States Patent [19]

Marton

[11] Patent Number: 4,499,939

[45] Date of Patent: Feb. 19, 1985

[54] PRODUCTION OF MACHINE ELEMENTS WITH PROTECTION CAGES CONNECTED THEREWITH BY MEANS OF A SINGLE CASTING OPERATION

[75] Inventor: Giulio Marton, Pavia, Italy

[73] Assignee: Necchi, Societa per Azioni, Pavia, Italy

[21] Appl. No.: 558,705

[22] Filed: Dec. 7, 1983

Related U.S. Application Data

[63] Continuation of Ser. No. 267,919, May 28, 1981, abandoned.

[30] Foreign Application Priority Data

Jun. 3, 1980 [IT] Italy ..... 42915 A/80

[51] Int. Cl.[3] ..... B22C 9/00; B22C 9/02

[52] U.S. Cl. ..... 164/23; 164/27; 164/30; 164/137

[58] Field of Search ..... 164/18-20, 164/23, 24, 27, 30, 34-36, 45, 516, 137

[56] References Cited

U.S. PATENT DOCUMENTS 3,041,688 7/1962 Wilder ..... 164/516

*Primary Examiner*—Nicholas P. Godici
*Assistant Examiner*—J. Reed Batten, Jr.
*Attorney, Agent, or Firm*—Stevens, Davis, Miller & Mosher

[57] ABSTRACT

Process for obtaining, by pig iron casting, machine elements provided with protection cages suitable to preserve delicate portions of machine elements from breaking and deforming during the production phase. The process consists in applying raised impressions of the cages on a pattern for green casting which impression corresponds to a print of a hardened shell reproducing the outer portions of the machine elements.

1 Claim, 4 Drawing Figures

FIG. 3
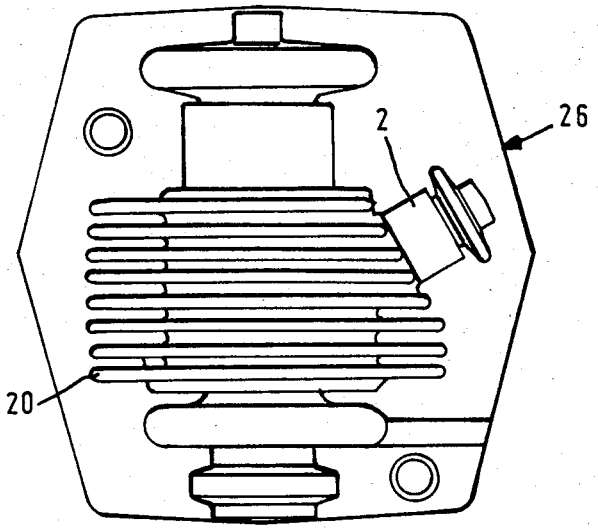
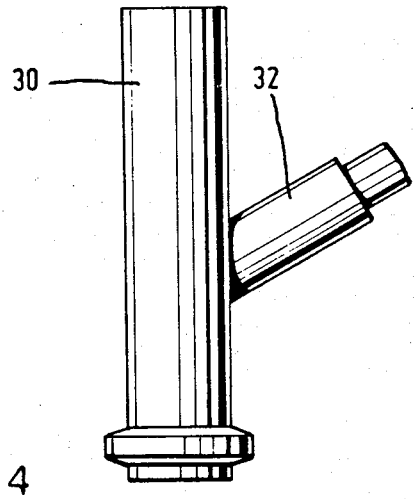
FIG. 4

PRODUCTION OF MACHINE ELEMENTS WITH PROTECTION CAGES CONNECTED THEREWITH BY MEANS OF A SINGLE CASTING OPERATION

This application is a continuation of application Ser. No. 267,919, filed May 28, 1981 and now abandoned.

DISCLOSURE OF THE INVENTION

The present invention relates to a process for the mass production of machine elements with protective cages connected thereto as a result of a single casting operation. In a pig iron foundry plant with green sand molds, the following operations of molding, casting and shaking out of the castings and conveyance from one working station to the following one, take place mechanically, without human intervention. During these operations the castings, having thin and delicate portions, such as, for example, cooling fins for combustion engine cylinders, can fall from a conveying line, bump one another or bump other bodies causing irretrievable damage.

It is therefore an object of the present invention to provide elements with cages to avoid this possible damage. The technical problem to be solved in order to attain the aforementioned object was to find a system during the phase of production where damage might occur which would protect the delicate parts, subject to breaking or deformation, without, at the same time causing excessive increase in the cost of producing the casting.

The solution of the technical problem for a particular molding process for green sand foundry plants is accomplished by firstly obtaining a hardened shell utilizing a pattern for the casting to be produced thereby reproducing the impression of the outer portion of the casting. The shell then is placed in molds as a core for the casting to be produced. A pattern mounted on a plate, whose molding impression corresponds to the print of the shell and defines relief impressions of a protective cage is utilized in creating the mold. After removal of the plate from the mold the mold components are placed together and the molten metal poured filling up the impression of the casting and then the impression of the cage.

Further advantages and characteristics of the invention will become apparent from the following description of a preferred embodiment of the invention and from the enclosed drawings in which:

FIG. 3 shows a half portion of the shell; and

FIG. 4 shows the core for obtaining the inside portion of the cylinder.

Figure 1:
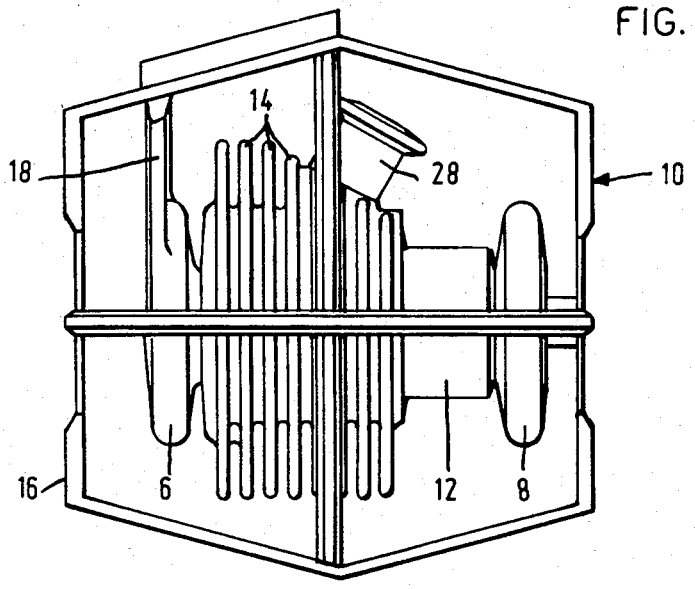
FIG. 1 shows the casting formed by a finned cylinder and its protective cage.

According to the invention the casting generally pointed out in FIG. 1 with numeral 10 is essentially formed by a cylinder 12 provided with cooling fins 14 and with a cage 16 containing cylinder 12 and connected thereto, by way of a gate 18, drawn up at one end of the cylinder. In order to attain the casting described hereinabove a process is followed whereby the advantage, i.e. of limiting the prime cost and exploiting green sand casting plants for the mass production of castings is accomplished. First of all, taking into account that the finned cylinder is obtainable only in a shell or by a core, in order to obtain smooth surfaces, necessary either to satisfy technical requirements such as, for example, rather close tolerances of shape and dimension, or to have outer surfaces with an aesthetically pleasant appearance, a pattern of the cylinder is utilized to form a core formed in three sections, two concerning the outer finned parts and one concerning the inside part of the cylinder. The three sections when assembled, form a shell which is the core for the shape to be obtained in green sand casting. The pattern applied to the plate is nothing but the print of the shell or core.

Around the plate pattern there is a raised portions to leave an impression of a cage which, according to the object of the invention, creates a molded protection for the fins around the cylinder. The cage is suitable to preserve the fins from breaking and/or deformation during the shakeout operation and conveyance of the casting to the final station where the cage is destroyed to free the cylinder. The material forming the cage is then recycled. According to the process described above, the cage 16 of FIG. 1 is connected to the cylinder 12 by means of the gate 18. Annular feedheads and heaters 6 and 8 are shown.

Figure 2:
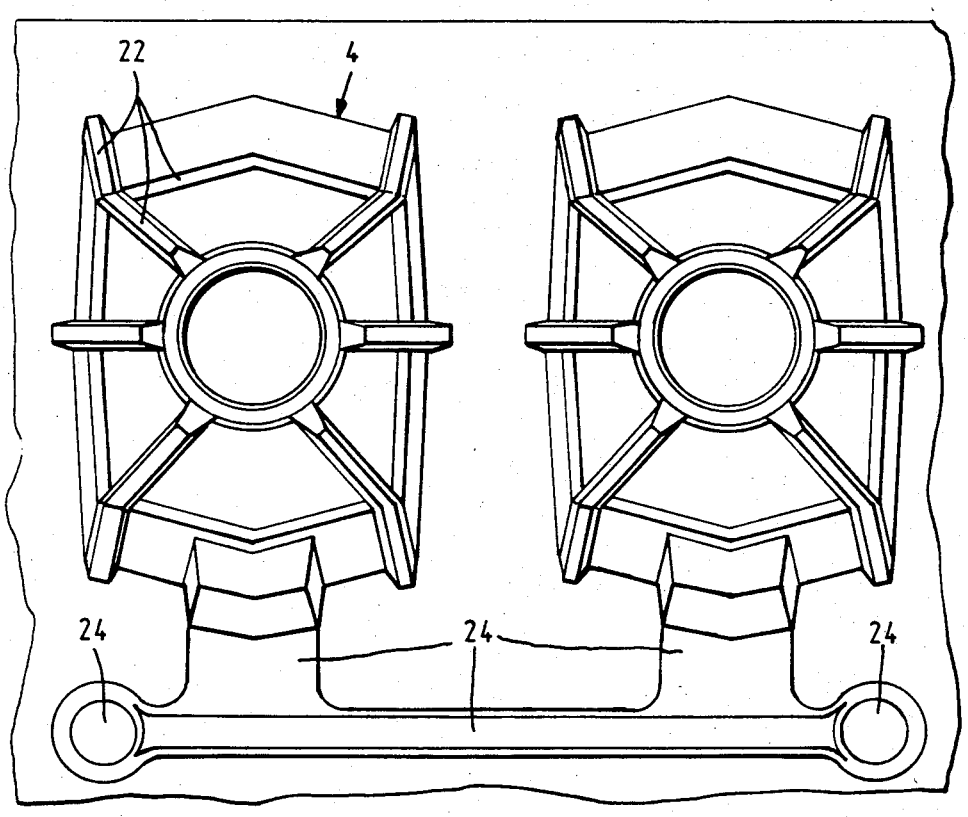
FIG. 2 shows a portion of the pattern plate.

In FIG. 2 raised portions 22 are formed on pattern 4 to obtain the casting of cage 16 by means of the gates 24. The pattern plate of FIG. 2 provides several cage patterns with a cage for every cylinder. Providing a cage for more than two cylinders and many other solutions, would obviously not overcome the field of protection of the present invention. In FIG. 3 a half of a shell 26 is shown with the impression 20 of the half portions of fins 14, impression 2 of exhaust pipe 28 and the impression of other secondary parts not directly pertinent to the process of the invention. Together with another half of a shell having impressions of the half portions of fins 14, impression 2 of exhaust pipe 28 and impressions of other secondary parts, and together with the central core 30 for obtaining the inside portion of cylinder 12, three sections are formed which, when assembled, form a core for the shape of the casting to be obtained in the green sand casting process.

In FIG. 4 central core 30 is shown suitable to form the inside recess of the cylinder. Portion 32 of the central core 30 creates the hole of the exhaust pipe 28.

The process described above is particularly suitable to obtaining grey pig iron castings which require a good superficial finishing and rather close tolerances of shape and dimension and have exteriorly particularly delicate parts whose damage during casting operations will cause rejection of the casting. The process requires the combination of technologies rather usual in grey pig iron foundry plants of large mass productions and the advantage of reducing to a minimum the increase in cost of the casting, greatly augmenting the value of the remarkable result obtained through the process of the present invention.

What is claimed is:

1. Process for the mass production of elements with protective cages connected therewith from a single casting operation comprising:

(a) creating a hardened shell containing a casting impression of the outer surface of the casting to be reproduced;

(b) forming by a pattern in a green sand casting mold a shell impression corresponding to the print of said shell, said pattern having raised portions for creating impressions of a cage to form communicating conduits with said casting impression;

(c) removing the pattern from the green sand casting mold;

(d) placing said shell in said shell impression in the green sand casting mold;

(e) pouring molten metal into said mold to create said casting and then said cage; and (f) shaking out said unitary casting and cage.

* * * * *